US005788234A

United States Patent [19]

Siofer

[11] Patent Number: 5,788,234

[45] Date of Patent: Aug. 4, 1998

[54] BUSINESS BOARD GAME

[76] Inventor: Artur Adam Siofer, 18 Kirkland Ave., Hamilton Ontario, Canada, L8V 3V9

[21] Appl. No.: 736,008

[22] Filed: Oct. 23, 1996

[51] Int. Cl.[6] ..... A63F 3/00

[52] U.S. Cl. ..... 273/256

[58] Field of Search ..... 273/256, 278

[56] References Cited

U.S. PATENT DOCUMENTS

| | | | |
|---|---|---|---|
| 2,666,644 | 1/1954 | Strehlow et al. | 273/256 |
| 3,163,423 | 12/1964 | Jackson | 273/256 |
| 3,198,521 | 8/1965 | Kramer et al. | 273/256 |
| 3,961,795 | 6/1976 | Anspach | 273/256 |
| 4,312,510 | 1/1982 | Bodner | 273/256 |
| 4,648,601 | 3/1987 | Carmichael | 273/241 |
| 4,871,177 | 10/1989 | Mock | 273/256 |

*Primary Examiner*—Benjamin H. Layno

[57] ABSTRACT

A business board game in which players attempt to win the game by transforming industries into cartels. Transformation of industries into cartels is by means of buying the majority of partnership stocks of all companies placed within specific industries. Controlling cartels enable players to sell essential products to their fellow players that own the partnership stocks in companies of other industries for a very high price to eventually cause bankruptcy. Such cartel product selling to other players is possible because the partnership stocks carry with them an unlimited liability. The game further includes cards that affect company book values per partnership stocks to further affect the market price of partnership stocks. Also, stock trading between players and the bank is involved where players try to make money by buying low and selling high, liquidate to cover expenses or just sell to escape the unlimited liability that comes along with owning partnership stocks. Players try to own as many partnership stocks as possible because they are the biggest source of income in the form of dividends. In addition, the game has a few companies that do not belong to any of the industries whose function is to provide services to the players for a fee.

4 Claims, 8 Drawing Sheets

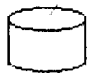

FIG 12

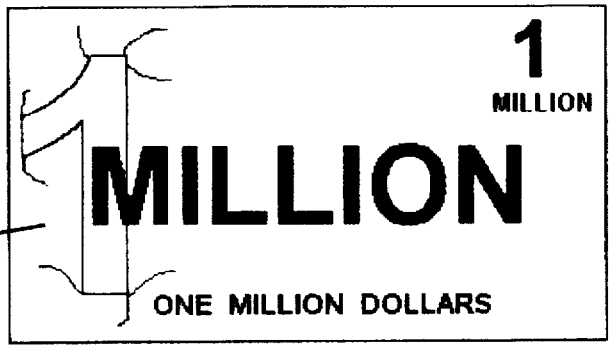

FIG 13

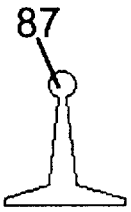

FIG 14

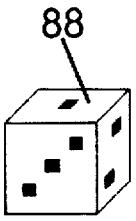

FIG 15

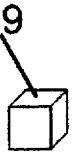

FIG 16

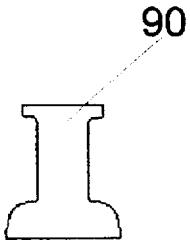

FIG 17

91

#1 INDUSTRY CARTEL — 92

| 93 Neighbouring company | 94 Dept owed to cartel |
|---|---|
| INDUSTRY 2 | |
| COMPANY 4 | $200 million / block |
| COMPANY 3 | $150 million / block |
| COMPANY 2 | $120 million / block |
| COMPANY 1 | $100 million / block |
| INDUSTRY 3 | |
| COMPANY 4 | $80 million / block |
| COMPANY 3 | $60 million / block |
| COMPANY 2 | $40 million / block |
| COMPANY 1 | $20 million / block |

Each player that owns two or more blocks in this cartel is to receive 10% of the cartel income for each two block set. — 95

FIG 18

BUSINESS BOARD GAME

REFERENCES CITED

| | | | |
|---|---|---|---|
| 3,756,604 | 9/1973 | Jackson | 273/256 |
| 4,440,397 | 4/1984 | Butner | 273/256 |
| 4,535,994 | 8/1985 | Cowan | 273/256 |
| 4,871,177 | 12/1987 | Mock | 273/278 |
| 4,934,707 | 1/1988 | Koster | 273/240 |

BACKGROUND OF THE INVENTION

The invention pertains to a business board game. Other finance board games have been developed which attempt to simulate playing the market. However, the objectives in these games are to amass a certain amount of money first or gain control of a certain amount of companies. The games which are based upon the formula of amassing a certain amount of money first tend to lack the skill of dog fighting in stock trading, planned buying, protecting an unwanted company take over, ect. The games which tend to follow the formula of gaining control of a certain amount of companies to win lack the concept of bankruptcy which is the driving force of competition today.

SUMMARY OF THE INVENTION

In the present invention, a business board game is designed with the objective of attempting to gain control of industries to form industry cartels to gain enough cartel control of the entire game as to start selling expensive essential products to the liable owners of companies to eventually force them out of the game either through bankruptcy or forcing them out of the game by reason of failing to compete. Not competing with other players represents a surrender.

The game includes a board which has a closed loop path divided into eight sections representing industries. Each industry has five spaces of which two to four are taken up by companies belonging to the industry. Each company of an industry is divided into five price segments to simulate predetermined book values of partnership stocks. Each player has the opportunity to buy these partnership stocks in any of the companies in an industry.

Uniting all companies in an industry by having stock majority in all of them, creates a cartel. Through a cartel a player sells essential expensive products to the companies of neighboring industries. By landing on a cartel company in one turn and landing on another company of a neighboring industry on a second turn, a player must buy a cartel product if on the second landing the company has his partnership stocks. Other players that own the partnership stocks in that company are also liable to pay for the cartel products since the company is a partnership.

This game creates a new objective in business board games by being based upon creating industry cartels to eventually corner players into buying cartel products for a very high price to eventually knock them out of the game through bankruptcy or force them out of the game by reason of failing to compete.

BRIEF DESCRIPTION OF THE DRAWINGS

FIG. 12 shows the value piece whose construction prefers a magnet underneath to act as a fastener on another magnet on the board game;

FIG. 13 illustrates an example of the play money which is provided;

FIG. 14 illustrates a token that may be provided;

FIG. 15 shows the preferred random generating device, which is typically a die;

FIG. 16 shows a block of partnership stock or block for short;

FIG. 17 shows a cartel token;

FIG. 18 illustrates one of eight certificates of industry cartel control.

DETAILED DESCRIPTION OF THE PREFERRED EMBODIMENTS

Figure 1:
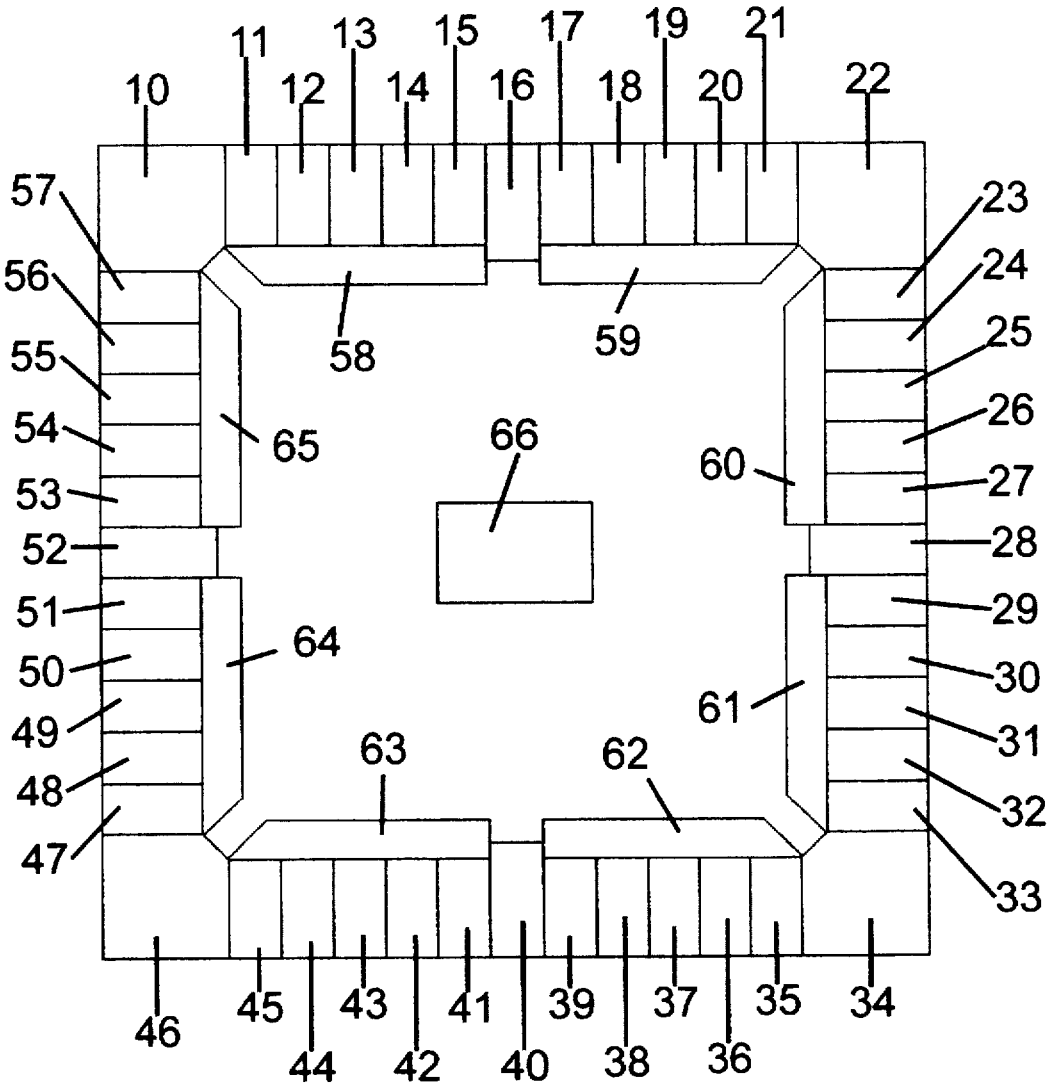
FIG. 1 illustrates a plan view of Oligopoly board game.
Figure 2:
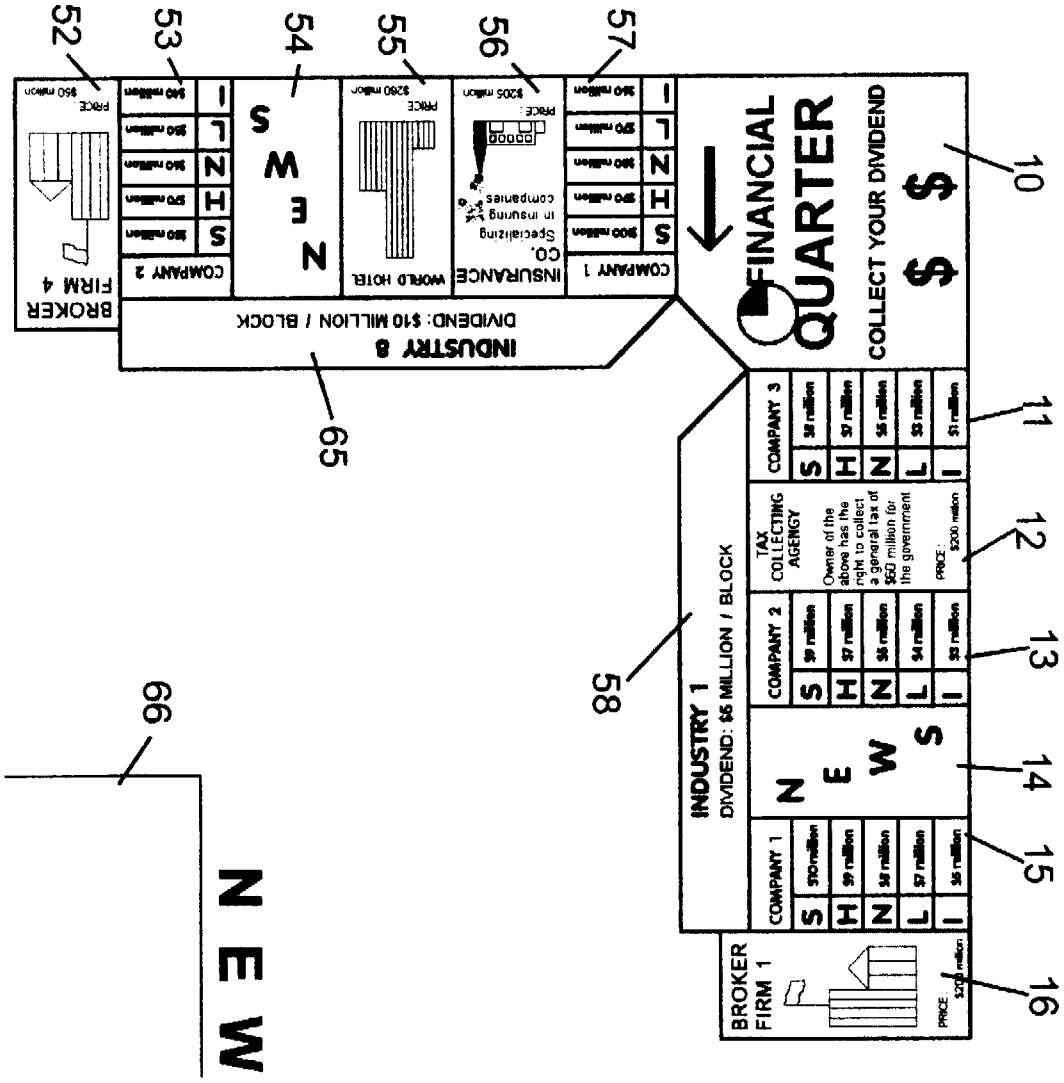
FIG. 2 illustrates a detailed upper left hand quarter of FIG. 1.
Figure 3:
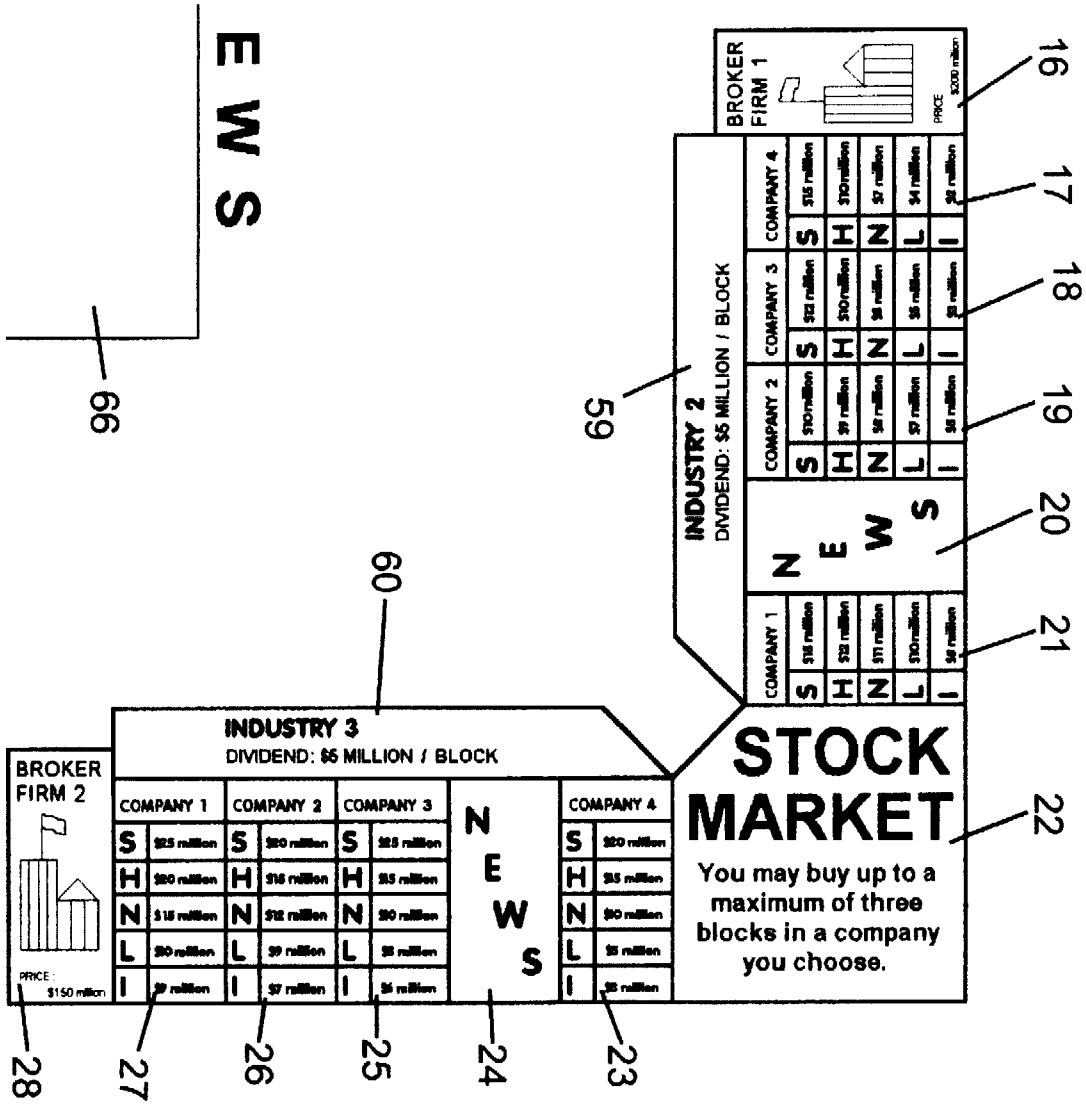
FIG. 3 illustrates a detailed upper right hand quarter of FIG. 1.
Figure 4:
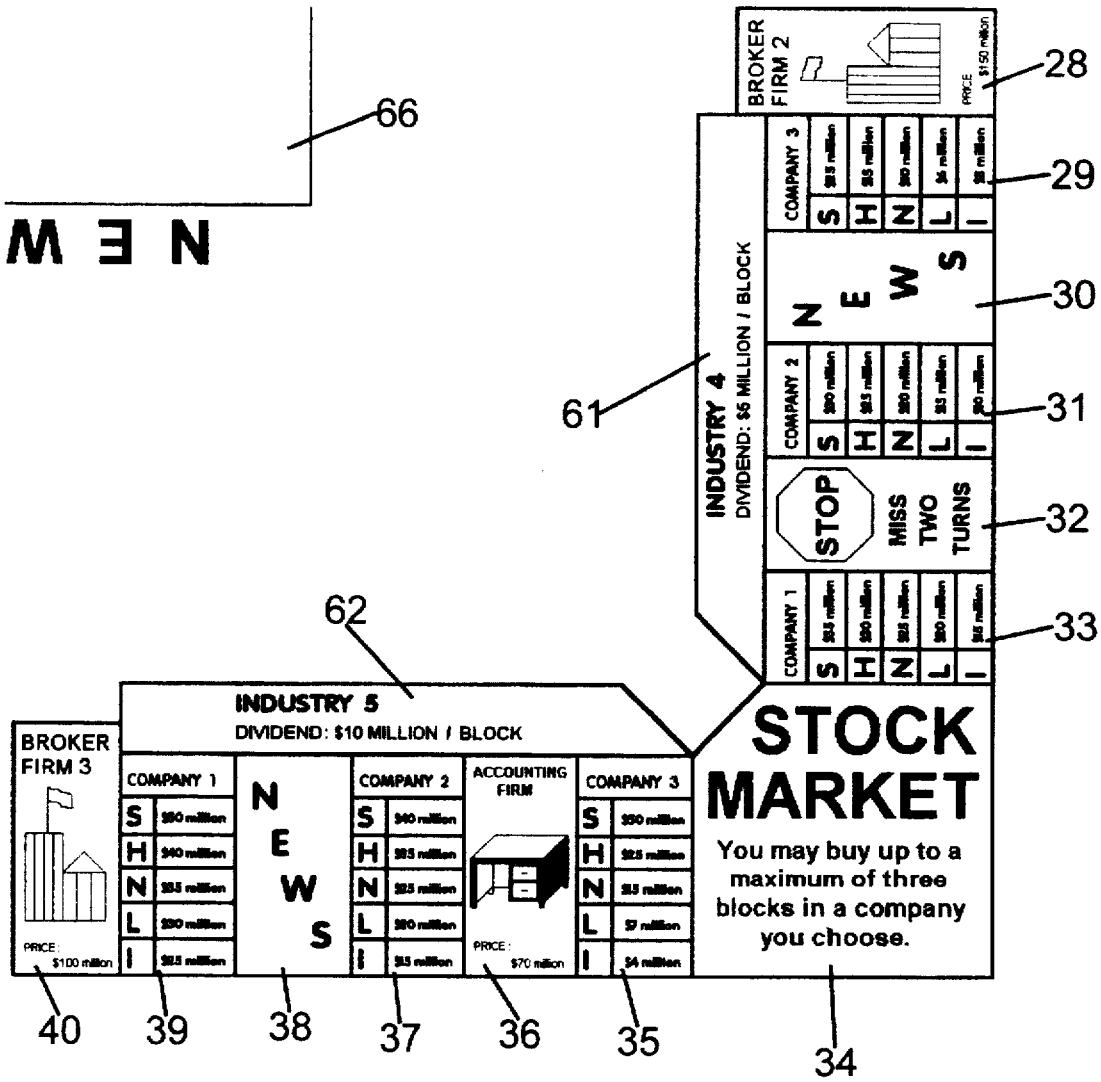
FIG. 4 illustrates a detailed lower right hand quarter of FIG. 1.

In FIG. 1 is shown the preferred game for playing Oligopoly. FIG. 1 is further divided into four quarters, FIG. 2, FIG. 3, FIG. 4 and FIG. 5 to illustrate the writing in each space. The board is provided with a closed loop path divided into forty-eight spaces. Thirty-five of the spaces represent different businesses or companies. Of these thirty-five businesses or companies, twenty-six are enlisted on the stock market where each company's ownership is made up of five blocks of partnership stocks. These twenty-six companies are grouped into eight different industries. The other nine companies or businesses have a regular purchase price that is independent from the stock market and with the purchase an ownership card is issued. Three spaces represent stock markets. One space represents a financial quarter. One space represents "STOP". One space represents "GO BACK AMOUNT THROWN" The remaining eight spaces affect the marketplace and/or the operation of the companies (belonging to industries) or whole industries thru the news.

The game involves eight industries. Each industry has its own area around the board and is made up of two to four companies. In the preferred embodiment, industry 1, space 58, is represented by three companies on spaces 11, 13 and 15; industry 2, space 59, is represented by four companies on spaces 17,18, 19 and 21; industry 3, space 60, is represented by four companies on spaces 23, 25, 26 and 27; industry 4, space 61, is represented by three companies on spaces 29, 31 and 33; industry 5, space 62, is represented by three companies on spaces 35, 37 and 39; industry 6, space 63, is represented by four companies on spaces 41, 42, 43 and 45;

industry 7, space 64, is represented by three companies on spaces 47, 49 and 51; industry 8, space 65, is represented by two companies on spaces 53 and 57.

Each space representing an industry space 67 (FIG. 6) is provided with an identification of the industry name 68 and dividend income 69. Preferably, each industry space should have a different background color.

Each space representing a company of an industry is provided with an identification of the company name 70 (FIG. 6), and five book values each represented by a letter and a corresponding price where 71 corresponds with 72, 73 corresponds with 74, 75 corresponds with 76, 77 corresponds with 78, and 79 corresponds with 80. The letters that represent the book values of companies are symbols for words that begin with the symbol letter. The symbols represent the following; S for Superior book value, H for High book value, N for Normal book value, L for Low book value, I for Inferior book value. Preferably, the spaces with the company name 70 and the industry space 67 have the same background color.

Figure 7:
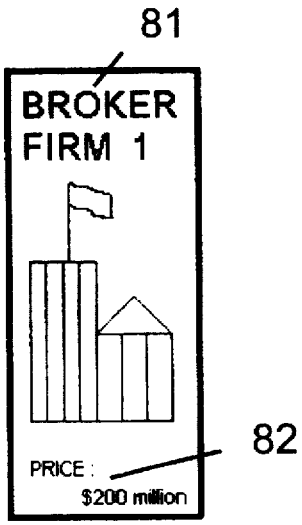
FIG. 7 illustrates one of the nine companies whose ownership is not made up of blocks of partnership stock.
Figure 8:
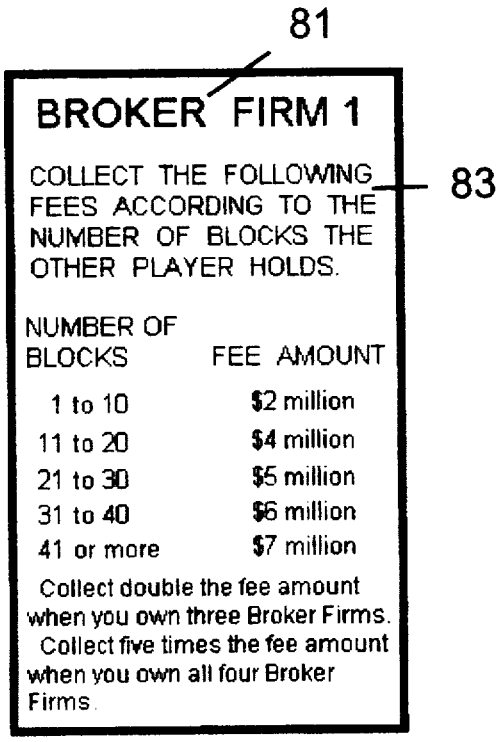
FIG. 8 shows the ownership of one of the nine companies mentioned in FIG. 7.

The remaining nine companies (not belonging to any one industry) FIG. 7, come with an identification name 81 and a purchase price 82. During a purchase a player receives an ownership card FIG. 8. The ownership has the companies identification name 81 and instructions 83 on how to collect money for providing services to other players. The nine companies' ownerships have similar or different instructions on how to collect money for providing a service.

Figure 9:
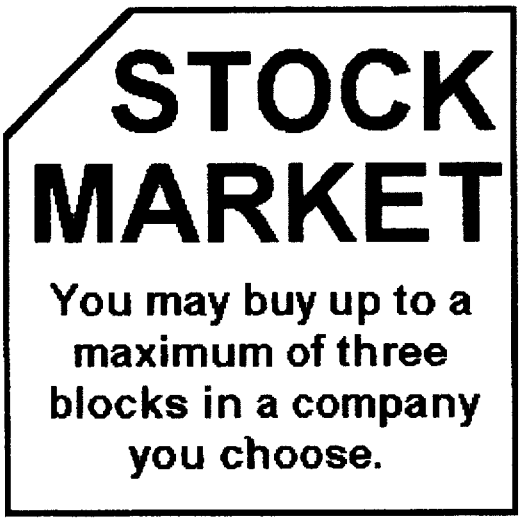
FIG. 9 illustrates one detailed Stock Market.
Figure 10:
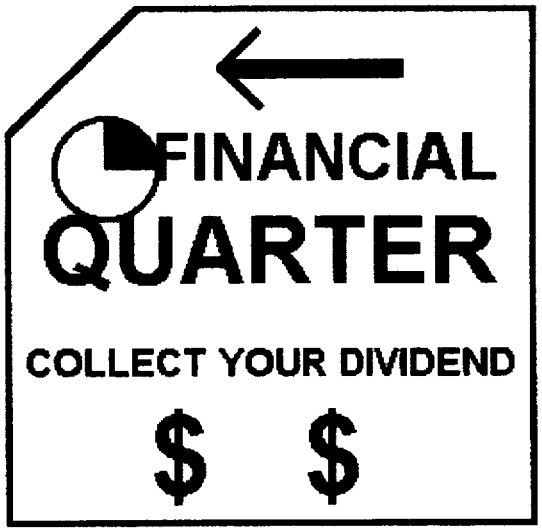
FIG. 10 illustrates the Financial Quarter

Three out of four corners are occupied by Stock Markets FIG. 9. The fourth corner FIG. 10 is occupied by the Financial Quarter.

Figure 5:
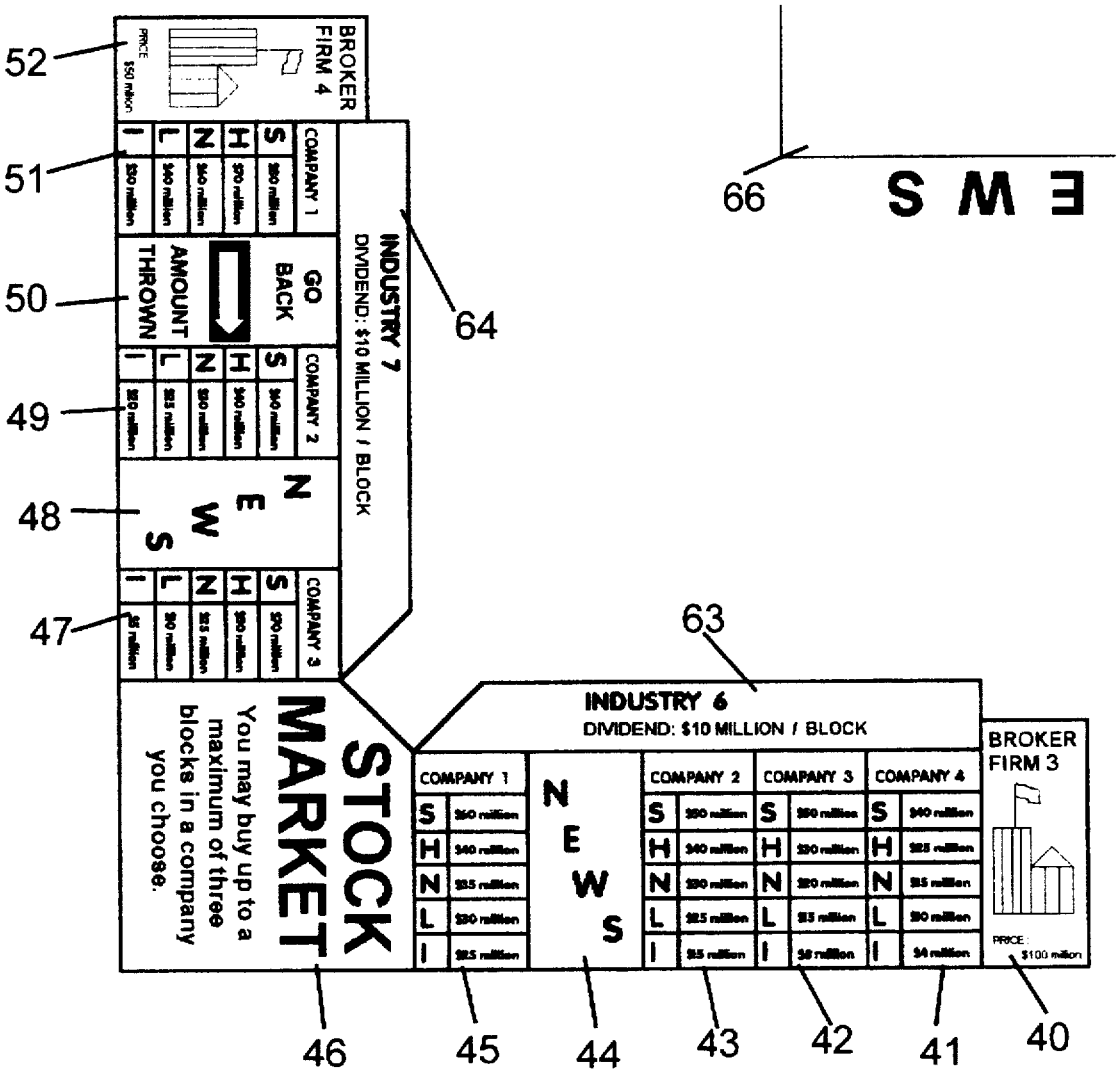
FIG. 5 illustrates a detailed lower left hand quarter of FIG. 1.

Eight spaces representing the news are located on spaces 54, 14 (FIG. 2), 20, 24 (FIG. 3) 30, 38 (FIG. 4), 44 and 48 (FIG. 5). These spaces affect the marketplace and/or the operation of the twenty-six companies located in the eight industries.

Two spaces, each represented by "STOP" and "GO BACK AMOUNT THROWN" are located on spaces 32 and 50 respectively.

Figure 11A:
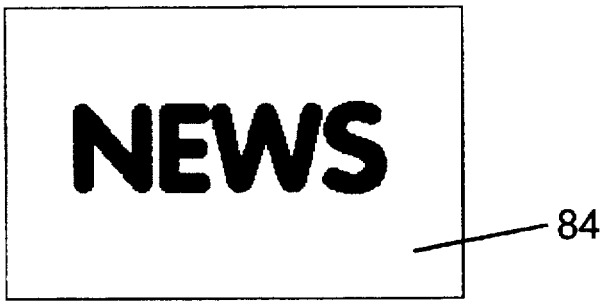
FIG. 11*a* illustrates an activity card—namely, the News card whose total is 170.
Figure 11B:
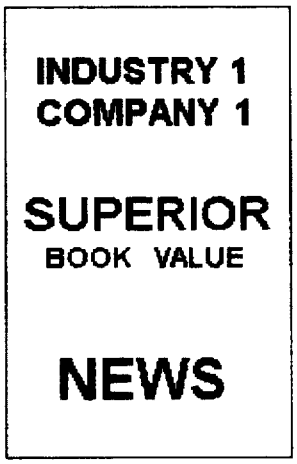
FIG. 11*b* illustrates one type of News card (FIG. 16*a*) when it is flipped over—namely a company news card, whose total is 130.
Figure 11C:
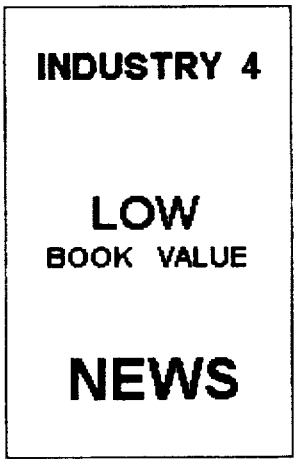
FIG. 11*c* illustrates a second type of News card (FIG. 16*a*) when it is flipped over—namely an industry news card, whose total is 40.

Area 66 (FIG. 1) called the NEWS PILE has news cards 84 (FIG. 11*a*) on it. FIG. 11*b* and FIG. 11*c* are the two types of news cards available when turned over.

The construction of the board game should have the following property: Underneath the paper lay out onto a hard board, there should be 26 very thin magnets. Each magnet is to be located underneath the five letters (S, H, N, L, and I), one for each of the 26 industry companies. The purpose of the magnets is to keep the value pieces 85 (FIG. 12) in place on top of the letters. More about the value pieces and the letters is explained in the below Game Rules. It has been found that the value pieces may change position without it being noticed during the game.

GAME RULES

The number of players is not fixed. Any reasonable number can play, but two to six players has been found most desirable. One of the players is chosen as a banker. He is given charge of the money, the selling of stocks, companies, certificates of ownership or cartel control, etc. Such person may be provided with an equal sum of money and in all ways participate in the game with the other players.

The game also includes a collection of play money in various denominations. FIG. 13 illustrates an example of one particular denomination of one million dollars 86. Preferably, the denominations of money would be provided in increments of one million, five million, twenty million, one hundred million and one billion. Of course, other useful denominations could be used. At the commencement of the game, the banker provides each of the players, including himself if he so participates, with an equal sum of money.

SETTING UP OLIGOPOLY BOARD GAME

1. Players choose their colored token 87 (FIG. 14) and place it on the FINANCIAL QUARTER 2. Value tokens 85 (FIG. 12) are placed on the letter N of each of the twenty-six companies making up the eight industries.

3. News cards are placed on the NEWS area 66.

4. A pot of $600 million is to be equally divided among the players in preferred denominations.

SPACES THAT A TOKEN MAY LAND ON

Tokens move around the board in a clock ward direction. Players throw three dice 88 (FIG. 15) to determine how many spaces to move. The space that a token lands on may be any one of the 48 spaces of the game, more specifically spaces 10 to 57 in FIG. 1 or FIG. 2, FIG. 3, FIG. 4 and FIG. 5.

COMPANIES OF INDUSTRIES

The game's twenty six companies are all owned by the bank at the commencement of the game. Players have the opportunity to buy them in the form of shares known as partnership stocks. Partnership stocks are part ownerships that carry with it the weight of unlimited liability. Unlimited liability holds the owner of a partnership stock liable for losses incurred during cartel product purchase. Also, each partnership stock carries with it the benefit of a dividend.

Each company's ownership is made up of five partnership stock units called blocks of partnership stock 89 (FIG. 16) or simply blocks for short. This means that, any player having one block in a company has an ownership of 20% in that company. Owning five blocks in a company carries an ownership of 100%.

The blocks come in as many different colors as there are players. The player's token color determines the color of the blocks that a player must use to represent his blocks in a company. They are placed on company names to identify the amount of blocks a player or players own in a company. The bank represents its ownerships in companies by invisible blocks, that is, wherever a company has less than five colored blocks present the bank owns the missing blocks. To buy or sell blocks, players must follow the below stock trading rules:

Buying when landing on a company

A player may buy blocks when he lands on a company. He may buy from the bank and/or other player. A player may buy as many as possible to reach a maximum amount of five blocks per company giving an ownership of 100%. When buying from the bank a player pays the book value per block.

The book value per block is simply what a block is worth at a particular time in the game. The book value per block is identified by the position of the value piece located on each company. It may be located on any one of the five letters S, H, N, L or I that have to its right a price in millions of dollars.

The position of the value piece is determined by news coming from the News cards. News cards are read by players that land on any one of the eight NEWS spaces during the game. News cards have information on how a company in an industry or an industry as a whole is performing. It values a company's or industry's blocks as Superior (S), High (H), Normal (N), Low (L), or Inferior (I). In another words, value pieces are positioned where the news coming from the News cards have placed it, thus the news coming from the News cards directly sets the book value for the blocks of companies.

When buying from the bank a player simply pays the bank and places his colored blocks on the company name. If he decides to buy from another player, he simply replaces the other player's blocks with his own.

Now, the difference between buying from the bank and another player is tremendous. The difference is the price a player pays for each block. To the bank a player pays only the book value for each block no matter how many invisible blocks the bank owns in the company. It matters how many blocks one player owns if another is buying from him. The more blocks a player owns in the company the more another has to pay him for each one. Simply, the more blocks a player owns in a company the higher the market price (which is dependent on the book value) is for each one of them. The five points below explain the system of payment for each block when one player buys from another:

1. If one player owns one block the other pays him the book value for that block.
2. If one player owns two blocks the other pays him two times the book value for each block.
3. If one player owns three blocks the other pays him three times the book value for each block.
4. If one player owns four blocks the other pays him for times the book value four each block.
5. If one player owns all five blocks the other pays him five times the book value for each block.

Selling to raise quick cash

A player may sell any amount of blocks he chooses either to another interested player or the bank at any time in the game. Below are the rules:

1. The player must announce that he wants to sell a number of his blocks to the highest bidder.
2. The player may only sell his blocks from one company at a time.
3. Having no interested players in buying any blocks, causes the bank to buy them at book value per block.
4. Having one interested player in buying the blocks results in a sale at book value per block. Other players have priority over the bank in buying blocks.
5. Having more than one interested player in buying the block(s) results in a bidding war. A bidding war is like an auction. The player sells his blocks to the one that will pay the most for them.
6. The player may proceed and sell blocks from other companies when he has finished business with the previous one. Again, he follows rules 2, 3, 4, and 5.
7. The player may only except cash on hand. (Players that are buying must check if they have enough cash on hand in order to raise their bids.)

In all cases the owner of the blocks has the last word if he wants to sell or not.

United companies in one industry create a cartel

A cartel in its simplest term is a union of companies in an industry that control a product's production, sale, and price to make a very high profit. A cartel in the present business board game is automatically formed when a single player owns at least three blocks in all the companies of an industry. A cartel does not exist when it falls anything short of the previous statement. A cartel is formed this way because a single player controls all the companies in an industry thru a majority, 3/5 or 60% of partnership stock. This corporate power gives that player the power to unite all the companies in the industry, and form a cartel.

Figure 6:
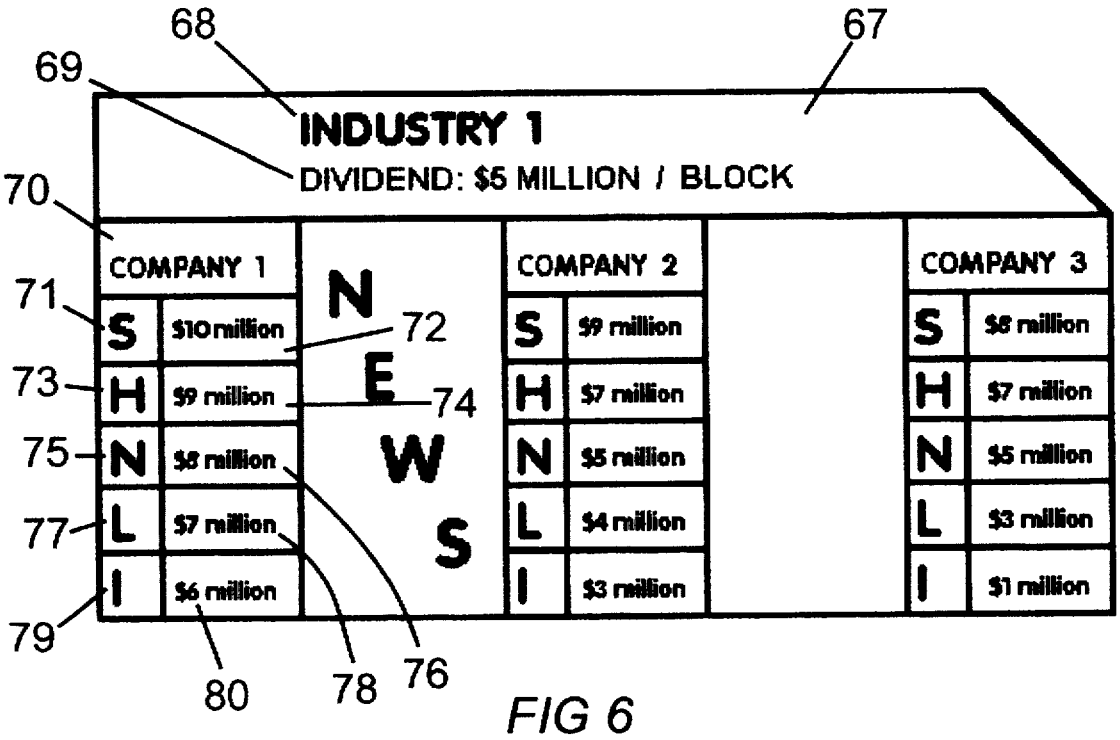
FIG. 6 illustrates one detailed industry.

As soon as a player has formed a cartel he has to identify it. A player uses the cartel tower 90 (FIG. 17) of his token color and places it any where on the industry space 67 (FIG. 6). With the formation of a cartel the player receives a certificate of industry cartel control FIG. 18. This certificate has the industry name as a cartel 91, an area 92 that is to have the same color as the industry space 67 (FIG. 6), neighbouring company 93 that might own a dept 94 to the cartel and the amount of money 95 that the cartel controller is to give to players that own two or more blocks in his cartel.

When a player controls a cartel he may be subjected to very big profits. During the game when another player lands on a company that is in a cartel, except the one that controls the cartel, should be prepared for a cartel purchase if on the next turn the player lands on a company of another industry. If the company he has landed on the second turn has at least one of his blocks, he and the other owners (other players that own blocks in the same company) of that company must make a cartel purchase referred to as debt to cartel. The amount of debt that each of the owners of the company owe depends on the amount of blocks that each one holds in that company. The more the blocks a player owns in the company the more debt is owed since the method of payment is based per each block.

The bank which owns the invisible blocks is not liable to pay to the cartel. The bank is to big of an organization to be bullied by any cartel.

The certificate of cartel control held by the cartel controller has the amounts figured out underneath "Dept owned to cartel" 94. The amounts are figured out per block owned. The further a company is away from a cartel, the less the owners of those companies are liable. The closer the company is to the cartel the more it is dependent on the cartel products which causes the cartel to charge more for its products.

When the dept is paid to the cartel controller, the cartel controller must sum up the money received and pay his part owners of his cartel. If another player owns two or more blocks in his cartel, the player must be paid 10% for every two block set owned, that is, four blocks earns that player 20%, ect., of cartel earnings.

A cartel can be lost in only one way. If for some reason the player that controls an industry cartel sells his blocks to own less than three blocks in all companies of the industry, the player looses the control of the cartel which results in giving up the certificate of cartel control and taking off the cartel tower.

Blocks in cartels are subjected to limited trade. Players that hold blocks in a cartel have the right to resist the sale of their blocks to anybody. Even the player that controls the industry cartel has no right to force a buy from the player that holds a few blocks in his cartel or vice versa. The players that own blocks in the cartel can at any time sell to anybody.

Finally, to avoid players running away from competition, cartel controllers have the right to demand that each player shall have no less than 5 blocks present on the board for each cartel present. A player may have less blocks than necessary if he controls at least one cartel. During the game when a cartel controller notices that another player has less than necessary blocks present without controlling a cartel, that player has to own the necessary blocks by the time he lands on any cartel company. If after the warning from the cartel controller the player lands on any cartel company without having the necessary blocks, he must pay each cartel control compensation of $1.000 billion for lost revenues.

STOCK MARKETS

Landing on Stock Market areas allow a player to buy up to a maximum of three blocks in a company. Landing here may be treated the same as landing on a company that a player wants to buy the blocks from. Again the buying may be from the government or another player. And off course, blocks form cartels are limited to trade.

FINANCIAL QUARTER

A player collects a dividend for owning blocks when he passes the Financial Quarter. Each block carries with it a dividend. The amount of dividend carried by each block is specified underneath the industry name that the blocks of a company belong to. The first four industries have a dividend of $5 million per block. The last four industries have a dividend of $10 million per block. Since it is possible to own many blocks, the banker keeps track of the dividend sum to avoid calculating the dividend every time a player passes the Financial Quarter. This releases the banker from calculating each player's dividend every time he passes the FINANCIAL QUARTER. When a player is buying or selling blocks, the banker adds or subtracts the amount of dividend that the block carries from or to the player's individual dividend sum.

COMPANIES THAT DO NOT BELONG TO ANY ONE INDUSTRY

All eight of these companies have a purchase price that stays the same throughout the whole game. With the purchase of each such company comes an ownership that informs how to charge the player that has landed. The charges are for services that the companies provide.

Broker Firms

The game has four Broker Firms spaces 16, 28, 40, and 52 (FIG. 2, FIG. 3, FIG. 4 and FIG. 5). Each Broker Firm has a different purchase price. The prices range from $50 million to $200 million. The ownership of the broker firm has printed information that specifies what the owner is entitled to in broker fees from the the player that has landed on his Broker Firm. The broker fees depend on the amount of blocks the other player owns in the industry companies. Owners of three Broker Firms are entitled to collect two times the amount that is specifed on the ownerships. Owners of all four Broker Firms are entitled to collect five times the amount that is specified on the ownerships.

Tax Collecting Agency

The Tax Collecting Agency, space 12 (FIG. 2) is a firm that collects a general tax for the government. The ownership specifies that the owner must collect a general tax of $60 million of which $20 million goes to the owner as commission. The plus of owning this agengy is that the owner does not pay the general tax.

Accounting Firm

The Accounting Firm, space 36 (FIG. 4) is a firm that collects an accounting fee from each company. The accounting fees are set up in such a way that when a player owns one or more blocks in a company, it counts as his company for accounting purposes.

World Hotel

The World Hotel, space 55 (FIG. 2) is a firm that collects an accomodation amount. The accomodation is set according to the throw of three dice. The accomodation is doubled when two dice have the same amount of spots and it is tripled when three dice have the same amount of spots.

Insurance Co.

The Insurance Co., space 56 (FIG. 2) is a firm that collects insurance from companies. Insurance is collected at $20 million per company. The player that owns three or more blocks pays the insurance for the company.

All of the nine companies may not be sold or traded between players or the bank. During bankruptcy, the companies are confiscated by the bank and they are not to be sold to other players during the rest of the game.

STOP and GO BACK AMOUNT THROWN

Landing on either one of the two causes to follow the written instruction on the space. Landing on stop causes a player to loose two turns. Landing on GO BACK AMOUNT THROWN causes the player to go back on the next turn the amount thrown with the dice.

The embodiments of the invention in which an exclusive property or privilege is claimed are defined as follows:

1. A business board game for play by two or more players comprising:

a board having a closed loop path having eight sections each separated by a space;

each said space is either a corner space or a space between said corner spaces;

one of said corner spaces represents a starting point of play; three of said corner spaces represent stock markets; said spaces between said corner spaces represent broker firms;

each said section represents an industry section which is identified by an identification name; each said industy section has underneath its said identification name imprinted a dividend for each stock unit owned in a company of said industry; each said industry section is also identified by a different background color;

each said industry section is made up of five adjacent spaces on which two to four of the said adjacent spaces represent different companies within said corresponding industry section, each space is imprinted with a business name that represents said company belonging to the said industry section; the area where the said name of the said company is printed has the same background color as the said industry section; the other said spaces is imprinted News and one of several other company names that do not belong to the said industry or any other said industries;

two or more playing pawns employed to designate movement of the player on the closed loop path;

chance means operated by the players for determining the movement of the pawns from one space to another space on the closed loop path;

one set of activity cards called News cards having imprinted thereon instructions that set the book value per said stock unit;

a plurality of asset means which include play money, a plurality of stock units, a plurality of ownership cards and a plurality of cartel control certificates;

said stock units are available for purchase with said asset means when said player lands on a space representing a company belonging to an industry; once in the hands of said player, said stock units may be traded between said players or the bank for said asset means; said stock units are represented by small cubes that come in a number of colors each representing said player;

said ownership cards are obtained with the purchase of said companies that do not belong to any of the said industries; each said cartel control certificate represents an industry section, wherein said name and said background color of said industry section is imprinted on said cartel control certificate.

2. The business game of claim 1 in which:

said spaces for each of said companies belonging to an industry being imprinted with five values each represented by a letter and a corresponding price; each of said values represents a book value per said stock unit; each said company belonging to said industry has one value token sitting on one of the said letters to designate one said book value per said stock unit at a particular time in the game; said value tokens on said companies move on said letters to change said book values per said stock unit; said value tokens change position on said letters according to said imprinted said instruction coming from said activity cards.

3. The business game of claim 1 wherein said player buys said stock units in said companies of said industries is further given the option to form a cartel of a said industry when the said player obtains a majority of said stock unit ownership in all said companies making up the said industry.

4. The business game of claim 3 wherein each said cartel of said industry has a said certificate of said cartel control certificate to be claimed by said player that has formed the said cartel of said industry; each said cartel control certificate has printed amounts another said player must pay for purchasing cartel products from the said player owning the said cartel control certificate.

* * * * *